US008971780B2

(12) United States Patent
Oohara

(10) Patent No.: US 8,971,780 B2
(45) Date of Patent: Mar. 3, 2015

(54) FIXING DEVICE, AND IMAGE FORMING APPARATUS USING THE FIXING DEVICE

(71) Applicant: Shunichi Oohara, Kanagawa (JP)

(72) Inventor: Shunichi Oohara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/799,875

(22) Filed: Mar. 13, 2013

(65) Prior Publication Data

US 2013/0272760 A1 Oct. 17, 2013

(30) Foreign Application Priority Data

Apr. 17, 2012 (JP) ..... 2012-094057
Feb. 5, 2013 (JP) ..... 2013-020270

(51) Int. Cl.
*G03G 15/20* (2006.01)

(52) U.S. Cl.
CPC ..... *G03G 15/2085* (2013.01)
USPC ..... 399/329; 399/328

(58) Field of Classification Search
CPC combination set(s) only.
See application file for complete search history.

(56) References Cited

U.S. PATENT DOCUMENTS 4,796,046 A * 1/1989 Suzuki et al. ..... 399/331
5,862,445 A * 1/1999 Ogawa et al. ..... 399/329
2004/0033092 A1* 2/2004 Aruga ..... 399/329

FOREIGN PATENT DOCUMENTS

JP 2004-264398 9/2004
JP 2004-264398 A * 9/2004 ..... G03G 15/20
JP 2005-338724 12/2005
JP 2008-216294 9/2008
JP 2011-033671 2/2011

* cited by examiner

*Primary Examiner* — Claytone E LaBalle
*Assistant Examiner* — Jas Sanghera
(74) *Attorney, Agent, or Firm* — Harness, Dickey & Pierce

(57) ABSTRACT

A fixing device including an endless belt; a pressing pad located inside the endless belt; a pressing roller pressed toward the pressing pad with the endless belt therebetween to form a fixing nip; an internal guide to position the endless belt; and an external guide, which is contacted with an outer surface of the endless belt at the exit side of the fixing nip to deform the endless belt. The pressing roller drives the endless belt to rotate.

13 Claims, 5 Drawing Sheets

FIXING DEVICE, AND IMAGE FORMING APPARATUS USING THE FIXING DEVICE

CROSS-REFERENCE TO RELATED APPLICATIONS

This patent application is based on and claims priority pursuant to 35 U.S.C. §119 to Japanese Patent Applications Nos. 2012-094057 and 2013-020270 filed on Apr. 17, 2012 and Feb. 5, 2013, respectively, in the Japan Patent Office, the entire disclosure of which is hereby incorporated by reference herein.

FIELD OF THE INVENTION

The present invention relates to a fixing device, and an image forming apparatus using the fixing device.

BACKGROUND OF THE INVENTION

Recently, electrophotographic image forming apparatuses forming images by melting toner images have been developed and broadly used as copiers, printers, multi-functional products, and the like.

Electrophotographic image forming apparatuses typically form images by passing a recording medium such as paper sheets bearing a toner image thereon through a fixing nip formed by a heated roller or belt to fix the toner image on the recording medium upon application of heat and pressure thereto.

Specifically, such image forming apparatuses form images, for example, by performing the following processes:

(1) charging a surface of a photoreceptor with a charger so that the photoreceptor has a charge thereon (charging process);

(2) irradiating the surface of the photoreceptor with laser light or LED (light emitting diode) light emitted by an irradiator according to image information to form an electrostatic latent image on the surface of the photoreceptor (irradiating process);

(3) developing the electrostatic latent image with a toner supplied from a developing device to form a visible image (toner image) on the surface of the photoreceptor (developing process);

(4) transferring the toner image onto a transfer belt (primary transfer process);

(5) re-transferring the toner image onto a recording medium (secondary transfer process);

(6) applying heat and pressure to the toner image using a fixing device to fix the toner image on the recording medium (fixing process).

The fixing device applies heat and pressure to the toner image on the recording medium using a combination of a roller and an endless belt while feeding the recording medium. Specifically, the fixing device typically includes a fixing member such as a roller or an endless belt, which heats the toner image, and a pressing member such as a roller or an endless belt, which is pressed to the fixing member. One example of the fixing device is a fixing device using a roller for each of the fixing member and the pressing member.

Since the nip of such a fixing device, which is formed by contacting a roller fixing member and a roller pressing member, cannot have a wide nip width, it becomes difficult to increase the heating time so as to be sufficient for melting a toner image when the printing speed is increased. In order to increase the nip width, there is a technique such that the thickness of the rubber layers on the rollers of such a fixing device is increased to increase the deformation amount of the rollers (rubber layers), resulting in increase of the nip width. However, such a fixing device has a drawback in that since the heat capacity of the rollers increases due to increase of the thickness of the rubber layers of the rollers, the rollers cannot be rapidly heated, thereby making it impossible to start a printing operation shortly after starting up the image forming apparatus (i.e., increase of start-up time).

In a fixing device having a roller fixing member and a belt pressing member, the nip width can be increased even when the rubber layer of the roller fixing member is relatively thin because the belt pressing member can be contacted with the surface of the roller fixing member over a relatively long distance, and therefore it become possible to increase the printing speed (fixing speed). In addition, it becomes possible to start a printing operation shortly after starting up the image forming apparatus (i.e., to decrease the start-up time) because the thickness of the rubber layer of the roller fixing member can be decreased, thereby decreasing the heat capacity of the roller fixing member.

However, such a fixing device has a drawback in that since the recording medium such as paper sheets is wound around the roller fixing member, the recording medium tends to be curled depending on the curvature of the roller fixing member.

In addition, when increasing the nip width in such a fixing device, the roller fixing member has to have a relatively large diameter. In this case, the heat capacity of the roller fixing member increases, thereby increasing the start-up time between start-up of the image forming apparatus and start of a printing operation.

In a fixing device having an endless belt fixing belt and an endless belt pressing member, it is possible to form a flat nip having a relatively long width, but at least one of the belts has to be rotated while tightly stretched by plural rollers. Therefore, the fixing device has a complex structure, and thereby the heat capacity of the fixing device is increased, resulting in increase of the start-up time of the image forming apparatus.

In attempting to solve such problems, a fixing device is proposed which has an endless belt, which is not tightly stretched; a heating member arranged in the endless belt to directly heat the endless belt; a pressing pad with a flat surface arranged in the endless belt; and a pressing roller having a soft rubber layer thereon and pressing the endless belt to form a fixing nip, wherein the endless belt is driven by the pressing roller so as to rotate.

When a toner image on a recording medium such as paper sheets is melted at a fixing nip of a fixing device, an adhesive force is generated, and the recording medium is attracted by the fixing member at the exit of the fixing nip. In this case, since the recording medium has large rigidity, the recording medium is generally peeled from the fixing member. However, when a thin recording medium having small rigidity is used and a solid image having a large area is formed thereon, a winding problem in that the recording medium is wound around the fixing member is caused.

In attempting to solve the winding problem, a fixing device is proposed in which a separating plate to separate a recording medium from a fixing member is arranged in the vicinity of the exit of the fixing nip. In addition, the fixing device includes a separating member (i.e., a guide), which is located inside the endless belt serving as the fixing member, to decrease the curvature radius of the endless belt so that the recording medium can be easily separated from the endless belt due to the rigidity thereof.

In addition, a fixing device is proposed in which a pressing pad arranged inside an endless belt has a convex portion on a downstream side from the fixing nip relative to the recording medium feeding direction to change the feeding direction of the endless belt toward the pressing roller at the exit of the fixing nip so that a recording medium can be easily separated from the endless belt.

In a fixing device such as the first-mentioned conventional fixing device, in which an endless belt is driven by a pressing roller, the resistance of the endless belt to feeding is preferably as small as possible to stably feed the endless belt. Therefore, in such a fixing device, the endless belt is arranged so as not to be contacted with members (such as guides arranged inside the endless belt and used for determining the feeding position of the endless belt) except for the pressing pad to form the fixing nip. However, in this fixing device, the endless belt is contacted with the guides at the end portions of the guides in the direction perpendicular to the feeding direction of the endless belt to prevent meandering of the endless belt. Therefore, the endless belt is slightly deformed at the end portions thereof because the end portions of the belt are contacted with such guides.

FIG. 4 is a side view illustrating a conventional fixing device used for image forming apparatuses. In the fixing device illustrated in FIG. 4, a pressing pad 33 and a heater 34 are arranged inside an endless belt 30. Positioning of the fed endless belt 30 is made by a guide member 32 serving as a first internal guide. Since a rotatable pressing roller 37 is pressed toward the pressing pad 33 with the endless belt 30 therebetween, a recording medium 13 such as films and papers and the endless belt 30 are fed by the pressing roller 37.

In this regard, when the recording medium 13 passes through a fixing nip 35, the endless belt 30 is deformed as illustrated in FIG. 5 due to the rigidity of the recording medium 13 and the adhesive force of the toner of a toner image on the recording medium 13.

FIG. 5 is a side view illustrating the conventional fixing device illustrated in FIG. 4 achieving a state, in which the endless belt 30 is deformed due to passing of the recording medium 13 bearing a toner image thereon through the fixing device.

Since the endless belt 30 is deformed at the exit of the fixing nip 35 as illustrated in FIG. 5, the rigidity (i.e., resistance to bending) of the recording medium 13 decreases in a range L, and therefore the recording medium 13 tends to be easily adhered to the endless belt 30, resulting in occurrence of the winding problem in that the recording medium is wound around the endless belt.

In this regard, even when the feeding direction of the endless belt 30 is changed toward the pressing roller 37 at the downstream side from the fixing nip 35 relative to the feeding direction of the recording medium 13, occurrence of this problem cannot be prevented because the endless belt 30 is deformed and the rigidity of the recording medium 13 decreases in the range L, thereby deteriorating the releasability of the recording medium 13 from the fixing member (endless belt 30).

For these reasons, the inventors recognized that there is a need for a fixing device which can securely feed a recording medium without causing the winding problem even when the recording medium has low rigidity and bears a solid image on the entire surface thereof.

BRIEF SUMMARY OF THE INVENTION

This patent specification describes a novel fixing device. One example of the fixing device includes an endless belt, a pressing pad located inside the endless belt, a pressing roller pressed toward the pressing pad with the endless belt therebetween to form a fixing nip, and an internal guide to position the endless belt, wherein the endless belt is driven by the pressing roller to rotate. The fixing device further includes an external guide, which is contacted with an outer surface of the endless belt at the exit side of the fixing nip to deform the endless belt.

This patent specification further describes a novel image forming apparatus. One example of the image forming apparatus includes a photoreceptor, an electrostatic latent image forming device to form an electrostatic latent image on a surface of the photoreceptor, a developing device to develop the electrostatic latent image with a developer including a toner to form a toner image on the surface of the photoreceptor, a transferring device to transfer the toner image onto a recording medium, and the above-mentioned fixing device to fix the toner image on the recording medium.

BRIEF DESCRIPTION OF THE SEVERAL VIEWS OF THE DRAWINGS

A more complete appreciation of aspects of the invention and many of the attendant advantage thereof will be readily obtained as the same become better understood by reference to the following detailed description when considered in connection with the accompanying drawings, wherein.

DETAILED DESCRIPTION OF THE INVENTION

Figure 1:
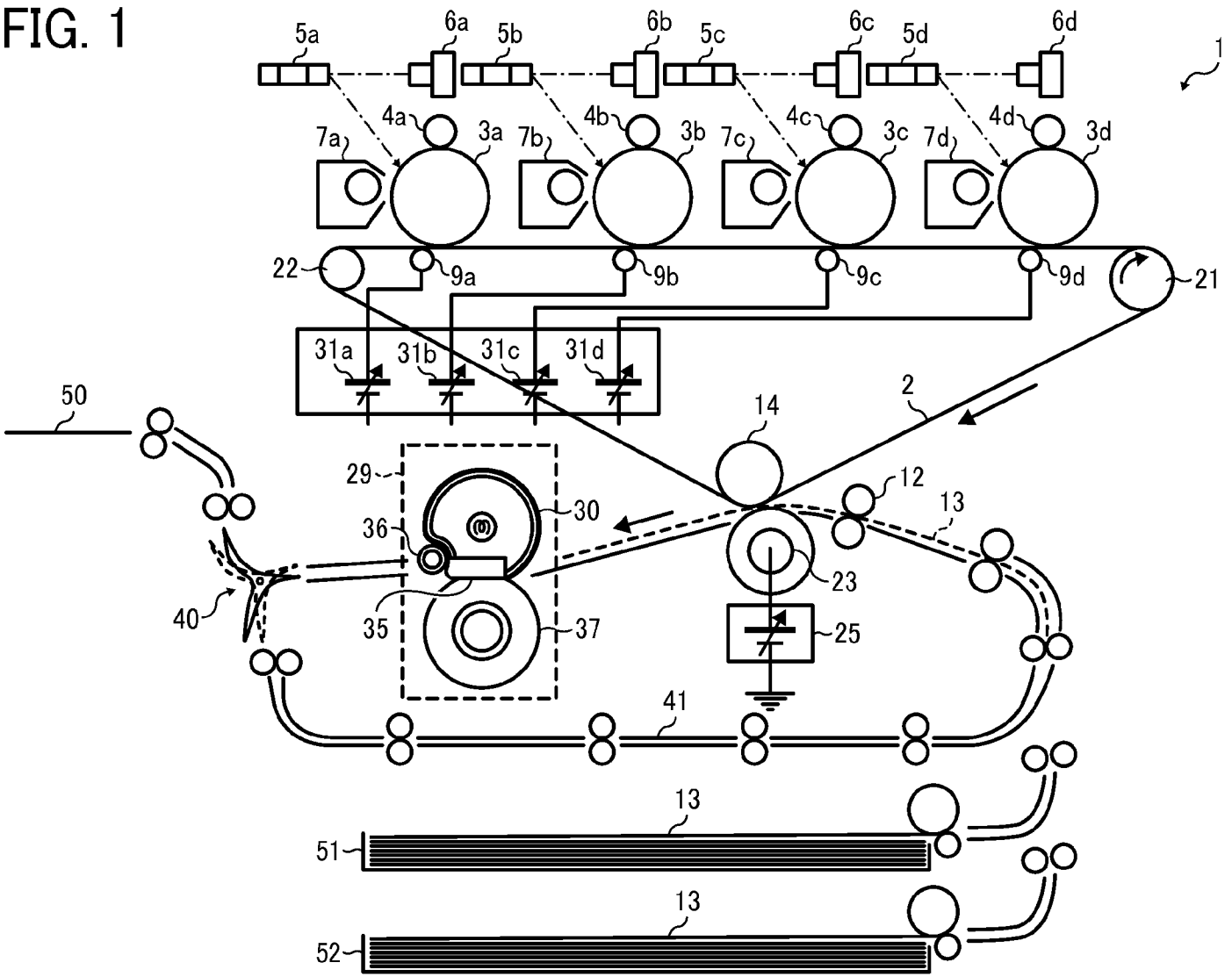
FIG. 1 is a schematic view illustrating a color image forming apparatus as one example of the image forming apparatus of the present embodiment.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

The problem to be solved by the present invention is to provide a fixing device and an image forming apparatus, which can securely feed a recording medium without causing the winding problem even when the recording medium has low rigidity and bears a solid image on the entire surface thereof.

The image forming apparatus of the present invention will be described by reference to an image forming apparatus having a color printing function, but the image forming apparatus of the present invention is not limited thereto.

FIG. 1 is a schematic view illustrating a color image forming apparatus as one example of the image forming apparatus of the present invention.

Referring to FIG. 1, an image forming apparatus 1 includes four image forming sections to form black (K), magenta (M), cyan (C) and yellow (Y) color toner images. Each image forming section includes a photoreceptor drum 3 (3*a*, 3*b*, 3*c* or 3*d*), a charging roller 4 (4*a*, 4*b*, 4*c* or 4*d*), an irradiator 6 (6*a*, 6*b*, 6*c* or 6*d*), a polygon mirror 5 (5*a*, 5*b*, 5*c* or 5*d*), and a developing device 7 (7*a*, 7*b*, 7*c* or 7*d*). The image forming sections are arranged side by side along an upper portion of an intermediate transfer belt 2.

The charging roller 4 charges the surface of the photoreceptor drum 3.

The irradiator 6 includes a laser diode, a LED or the like to emit a light beam.

The polygon minor 5 is rotated at a constant high speed by a motor to scan the surface of the photoreceptor drum 3 in a main scanning direction with the light beam emitted by the irradiator 6.

In this image forming apparatus, the charging roller 4, the irradiator 6, and the polygon mirror 5 serve as an electrostatic latent image forming device, which forms an electrostatic latent image on the surface of the photoreceptor drum 3.

The developing device 7 contains a color developer therein to develop the electrostatic latent image on the photoreceptor drum 3.

In addition, the image forming apparatus 1 includes a transferring device, which includes the intermediate transfer belt 2, which is supported by feed rollers 14, 21 and 22, primary transfer rollers 9 (9*a*, 9*b*, 9*c* and 9*d*), and a secondary transfer roller 23; and a fixing device 29.

The image forming apparatus 1 illustrated in FIG. 1 is a tandem color image forming apparatus.

Next, the image forming operation of the image forming apparatus 1 will be described.

Initially, the charging rollers 4*a*, 4*b*, 4*c* and 4*d* negatively charge the photoreceptor drums 3*a*, 3*b*, 3*c* and 3*d*, respectively, to uniformly charge the surfaces of the photoreceptor drums. The irradiators 6*a*, 6*b*, 6*c* and 6*d* respectively output light beams according to signals of images to be written. The light beams respectively irradiate the charged surfaces of the photoreceptor drums 3*a*, 3*b*, 3*c* and 3*d* to form electrostatic latent images on the photoreceptor drums, wherein the electrostatic latent images have potentials depending on the irradiation conditions such as irradiation or non-irradiation of a light beam, and the light quantity of the light beam. In this regard, the image signals are black (K), magenta (M), cyan (C) and yellow (Y) image data, which are prepared by decomposing image data sent from a scanner or a personal computer. The electrostatic latent images thus formed on the photoreceptor drums 3*a*, 3*b*, 3*c* and 3*d* are fed toward the respective developing devices 7*a*, 7*b*, 7*c* and 7*d* as the photoreceptor drums are rotated, and the developing devices electrostatically develop the electrostatic latent images with respective developers including black (K), magenta (M), cyan (C) and yellow (Y) toners, resulting in formation of K, M, C and Y color toner images on the photoreceptor drums 3*a*, 3*b*, 3*c* and 3*d*.

The intermediate transfer belt 2 is arranged below the photoreceptor drums 3*a*, 3*b*, 3*c* and 3*d* while tightly stretched by the feed rollers 14, 21 and 22. The intermediate transfer belt 2 is fed in a direction indicated by an arrow. The primary transfer rollers 9*a*, 9*b*, 9*c* and 9*d* serving as a primary transfer device are arranged so as to be contacted with the respective photoreceptor drums 3*a*, 3*b*, 3*c* and 3*d* with the intermediate transfer belt 2 therebetween, and primary transfer bias voltages are applied thereto by respective power sources 31*a*, 31*b*, 31*c* and 31*d*. By applying the primary transfer bias voltages, the K, M, C and Y color toner images are transferred from the photoreceptor drums 3*a*, 3*b*, 3*c* and 3*d* to proper positions of the intermediate transfer belt 2 to form a combined multiple color toner image, in which the K, M, C and Y color toner images are overlaid, on the intermediate transfer belt. After the color toner images are transferred, residual toners on the surfaces of the photoreceptor drums 3*a*, 3*b*, 3*c* and 3*d* are removed therefrom by respective photoreceptor cleaners, and then residual charges remaining on the surfaces of the photoreceptor drums are discharged by respective dischargers, so that the photoreceptor drums are ready for the next image forming operation.

The combined color toner image on the intermediate transfer belt 2 is fed toward the secondary transfer roller 23 serving as a secondary transfer device.

Meanwhile, a recording medium 13 such as paper sheets set in a sheet cassette 51 or 52 is timely fed toward the secondary transfer roller 23. When the tip of the thus fed recording medium 13 is contacted with a pair of registration rollers 12, the recording medium is stopped once while positioned so that the tip of the recording medium becomes perpendicular to the recording medium feeding direction. The recording medium 13 is timely fed by the pair of registration rollers 12 to the secondary transfer roller 23 so that the combined multiple color toner image on the intermediate transfer belt 2 is transferred onto the proper position of the recording medium 13 at the secondary transfer roller (i.e., secondary transfer nip). In this regard, a charge (secondary transfer bias) is applied to the secondary transfer roller 23 by a power source 25, so that the combined multiple color toner image can be well transferred electrostatically onto the recording medium 13. The recording medium 13 bearing the combined multiple color toner image thereon is fed to a fixing nip 35 formed between a heated endless belt 30 and a pressing roller 37 of the fixing device 29, which is surrounded by a dotted line in FIG. 1 so that the combined multiple color toner image is fixed on the recording medium, resulting in formation of a full color image on the recording medium. In this regard, the recording medium 13 is a sheet-form medium, and specific examples thereof include sheet-form papers, plastics, films, clothes, and thin metal films.

After the fixing operation, the recording medium 13 is fed along a discharge passage so as to be discharged from the image forming apparatus 1 and then stacked on a copy tray 50. When a duplex copy is formed, the recording medium 13 bearing the full color image thereon is fed along a duplex-copy passage 41 by switching a flap 40 so as to be fed toward the pair of registration rollers 12, and a second image is formed on the backside of the recording medium 13 by the method mentioned above. After fixing the second image, the duplex copy is discharged from the image forming apparatus 1 so as to be stacked on the copy tray 50.

After the combined multiple color toner image is transferred, residual toners on the intermediate transfer belt 2 are removed therefrom by a cleaner such as cleaning blades so that the intermediate transfer belt is ready for the next image forming operation.

Figure 2:
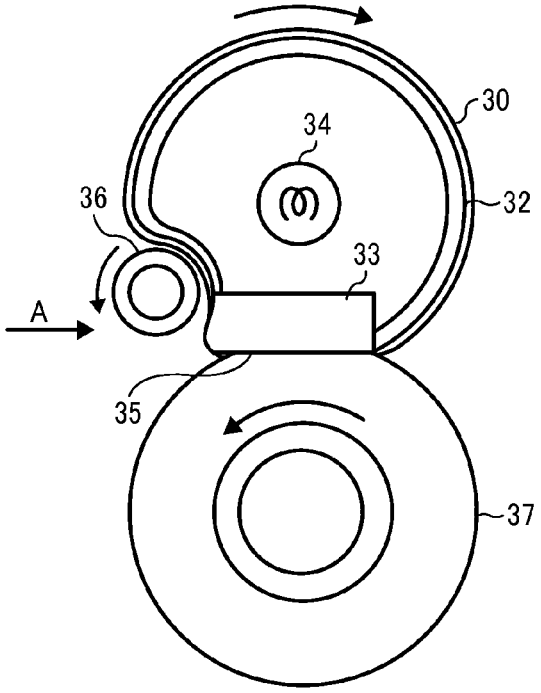
FIG. 2 is a side view of the fixing device of the color image forming apparatus illustrated in FIG. 1.
Figure 3:
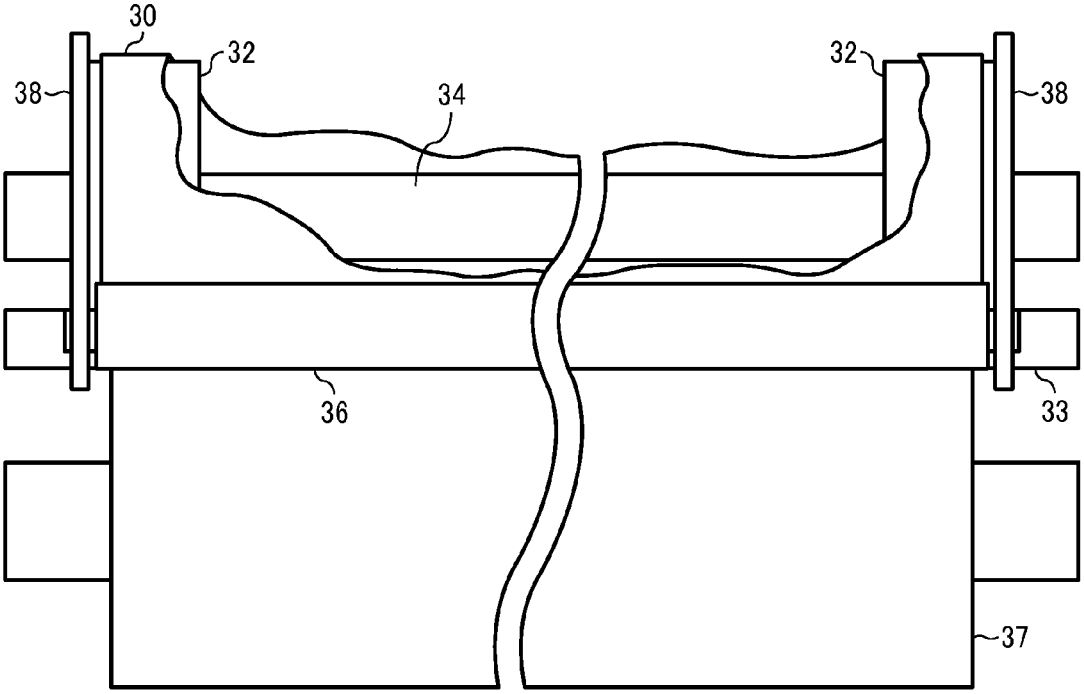
FIG. 3 is an elevation view of the fixing device when the fixing device is observed from a direction A illustrated in FIG. 2.

FIG. 2 is a side view of the fixing device 29 illustrated in FIG. 1, and FIG. 3 is an elevation view of the fixing device when the fixing device is observed from a direction A illustrated in FIG. 2.

In the fixing device 29 illustrated in FIG. 2, a pressing pad 33 and a heater 34 are arranged inside an endless belt 30. The endless belt 30 is positioned by a guide member 32 but is not tightly stretched thereby, namely it is preferable for the guide member not to contact the endless belt if possible so that the guide member does not become load. In FIG. 2, the recording medium 13 is inserted from right and is discharged to left.

Figure 4:
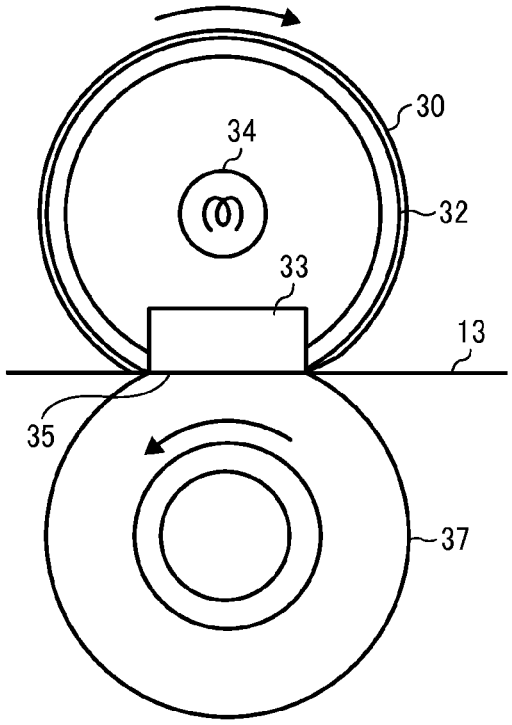
FIG. 4 PRIOR ART
FIG. 4 is a schematic side view illustrating a conventional fixing device used for image forming apparatuses.

Since the guide member 32 is pressed by a guide roller 36, the guide member has a dimple. Namely, the guide member 32 has a circular form at the exit of the fixing nip 35 like the guide member 32 of the conventional fixing device illustrated in FIGS. 4 and 5, but the guide member 32 has a dimple in the vicinity of the exit of the fixing nip 35.

In this regard, the passage "the guide member does not become load" means that the outer perimeter of the combination of the pressing pad 33 and the guide member 32 is shorter than the inner perimeter of the endless belt 30. In addition, the passage "the guide member does not contact the endless belt if possible" means that the ratio of the inner perimeter of the endless belt 30 to the outer perimeter of the combination of the pressing pad 33 and the guide member 32 is from 100:98 to 100:95, so that the endless belt 30 is fitted loosely over the guide member 32.

Metals such as iron-based metals are used for the pressing pad 33. In this regard, in order to reduce the sliding resistance of the pressing pad 33, it is preferable that the surface of the pressing pad 33 contacting the endless belt 32 is coated with a fluorine-containing resin, or a cloth woven from fluorine-containing strings including a lubricant is arranged between the endless belt and the pressing pad.

Figure 5:
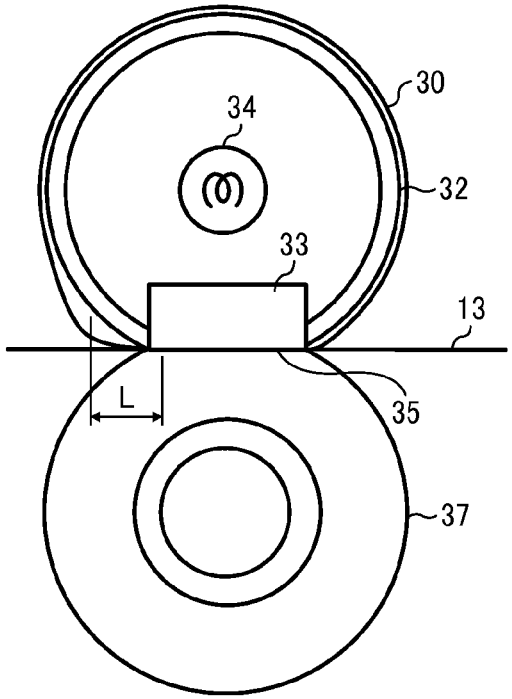
FIG. 5 PRIOR ART
FIG. 5 is a schematic side view illustrating the conventional fixing device illustrated in FIG. 4 in which the endless belt used for feeding a recording medium is deformed.

The pressing roller 37 is pressed toward the pressing pad 33 with the endless belt 30 therebetween, thereby forming the fixing nip 35. The guide roller 36 is pressed to the outer surface of the endless belt 30 at the dimple of the guide member 32, so that the endless belt 30 is deformed so as to have a cross-section having a recessed portion, thereby preventing deforming of the endless belt 30 in the feeding direction of the recording medium 13 (i.e., deforming of the endless belt as illustrated in FIG. 5). Although the endless belt 30 is largely deformed at the exit of the fixing nip 35 in the conventional fixing device illustrated in FIG. 5, deformation of the endless belt 30 is reduced by the guide roller 36 in the fixing device of the present invention illustrated in FIG. 2. Since the pressing roller 37 is rotated in a direction indicated by an arrow (i.e., counterclockwise) by a driving device, the endless belt 30 is driven to rotate in a direction indicated by an arrow (i.e., clockwise) by the pressing roller 37, and the guide roller 36 is also rotated in a direction indicated by an arrow (i.e., counterclockwise).

As illustrated in FIG. 3, the guide member 32 guides both the end portions of the endless belt 30. Namely, the guide member 32 does not cover the heater 34, which faces the central portion of the endless belt 30, and therefore the endless belt is directly heated by the heater 34, thereby making it possible to heat the endless belt 30 in a short time, resulting in shortening of the start-up time of the image forming apparatus 1. Movement of the endless belt 30 in the width direction thereof is restricted by flanges 38. In this regard, the guide member 32 guides the endless belt 30 from the inside thereof, and therefore the guide member is called "an internal guide." In contrast, the guide roller 36 guides the endless belt 30 from the outside thereof, and therefore the guide roller is called "an external guide."

The endless belt 30 typically has a structure such that on a substrate made of a material such as a nickel or polyimide film and having a thickness of tens of micrometers, an elastic layer made of a silicone rubber and having a thickness of from tens of micrometers to hundreds of micrometers is formed on the substrate, and a fluorine-containing resin layer having a thickness of tens of micrometers is formed as an outermost layer.

The pressing roller 37 typically has a structure such that an elastic layer made of a flexible rubber and having a thickness of about 10 mm is formed on a metal cylinder or a metal rod, and a fluorine-containing resin layer having a thickness of tens of micrometers is formed as an outermost layer. In this example of the fixing device, the pressing roller 37 does not include a heating member such as heaters, but the pressing roller 37 can have a structure such that a heater is arranged inside a metal hollow cylinder, or an electroconductive layer is formed as an outermost layer thereof to be heated by induction current. Although such a fixing device has a slightly complex structure, the temperature of the recording medium 13 at the fixing nip 35 can be increased, and the fixability of toner images to the recording medium can be enhanced, thereby making it possible to perform the fixing operation at a high speed.

The guide roller 36 is preferably a metal roller whose surface is coated with a fluorine-containing resin to prevent the surface of the guide roller from being contaminated.

The metal used for the pressing roller 37 and the guide roller 36 is preferably iron or aluminum.

Figure 6:
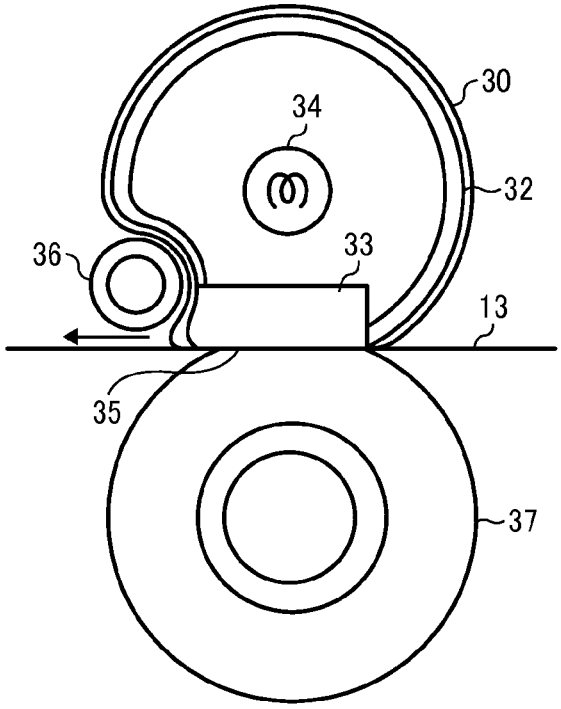
FIG. 6 is a schematic view for describing an example of the fixing device of the present invention in an operating state.

FIG. 6 is a schematic view for describing the operation of an example of the fixing device of the present invention.

The recording medium 13 is fed in a direction indicated by an arrow. When the recording medium 13 bearing a toner image thereon is fed through the fixing nip 35, the endless belt 30 is attracted by the recording medium 13 due to the adhesive force of the melted toner of the toner image. In this fixing device, deformation of the endless belt 30 in the recording medium feeding direction can be prevented by the guide roller 36, which is rotatably supported. Even when the endless belt 30 is deformed to an extent in a direction indicated by an arrow, the endless belt 30 is further curved by the guide roller 36 and the guide member 32 so that the recording medium 13 is fed toward the pressing roller 37, and thereby the endless belt 30 can be easily released from the recording medium 13.

Since this fixing device has such a structure, the recording medium 13 can be easily released from the endless belt 30 and printing can be stably performed even when the recording medium is thin and has low rigidity, and a solid image is formed on the entire surface of the recording medium. In this fixing device, the guide roller 36 deforms the endless belt 30 so as to have a cross-section having a concave (dimple) while contacting the endless belt to reduce deformation of the endless belt in the recording medium feeding direction, thereby making it possible to preventing deterioration of releasability of the endless belt 30 from the recording medium 13 due to deformation thereof. In addition, since the guide roller 36 deforms the endless belt 30 so as to have a cross-section having a concave (dimple), the curvature of the endless belt 30 at the exit of the fixing nip 35 can be increased (i.e., the curvature radius is decreased), the recording medium 13 can be stably released from the endless belt 30 even when the recording medium is thin and has low rigidity.

Therefore, the image forming apparatus 1 for which the fixing device of this example is used can stably perform printing by stably releasing the recording medium 13 from the fixing device even when the recording medium is thin and has low rigidity, and a solid image is formed on the entire surface of the recording medium. In addition, the device to drive the endless belt 30 to rotate has a simple structure, and the endless belt is directly heated by the heater 34. Therefore, the fixing device has a low heat capacity, and the image forming apparatus can start the image forming operation with a short start-up time.

In this regard, the term "simple structure" of the driving device means that it is not necessary for the driving device to have a structure such that plural rollers are provided inside the endless belt 30 to tightly stretch the endless belt and to generate a frictional force between the rollers and the endless belt 30, and the rollers are rotated to drive the endless belt.

The outer diameter (OD1) of the guide roller 36, the outer diameter (OD2) of the endless belt 30, and the distance (D) between the axis of the guide roller 36 and the axis of the endless belt 30 preferably satisfies the following relationship:

$$D<(OD1)/2+(OD2)/2.$$

Figure 7:
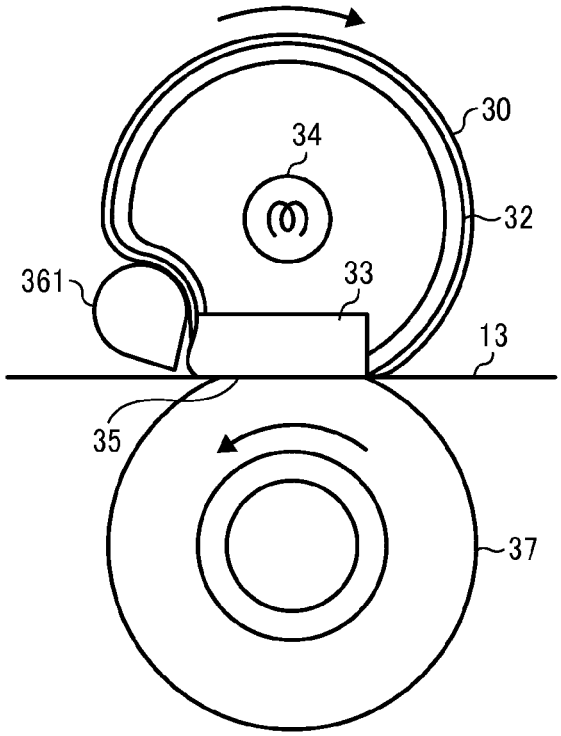
FIG. 7 is a schematic view illustrating another example of the fixing device of the present embodiment.

FIG. 7 is a schematic view illustrating another example of the fixing device of the present invention. The difference between the fixing device illustrated in FIG. 7 and the fixing device illustrated in FIG. 2 is that a guide 361 (hereinafter sometimes referred to as an external guide 361), which is not rotatable and which deforms the endless belt 30 in a direction opposite to the recording medium feeding direction is provided instead the guide roller 36. In this regard, the term "external guide" means a guide which guides the endless belt 30 from outside.

The external guide 361 is typically made of a metal such as iron and aluminum, and the surface thereof is coated with a fluorine-containing resin or the like to reduce friction between the guide and the endless belt 30.

The external guide 361 has a shape such that the portion thereof to be contacted with the endless belt 30 has a gently curved surface to reduce friction between the surface and the endless belt while having a sharp edge, which faces the exit of the fixing nip 35. Specific examples of the shape of the external guide 361 include such a teardrop shape as illustrated in FIG. 7. In a case where the recording medium 13 exits from the fixing nip 35 and is nearly wound around the endless belt 30, the sharp edge of the external guide 361 forcibly releases the recording medium 13 from the endless belt 30 because the sharp edge is located between the recording medium 13 and the endless belt 30, and therefore the recording medium can be easily released stably from the endless belt even when the recording medium is so thin that the recording medium cannot perform curvature releasing.

In addition, the guide member 32 has a dimple facing the guide 361 similar to the guide member 32 of the fixing device illustrated in FIG. 2 so that the recording medium can be easily released from the endless belt 30. The guide member 32 is hereinafter sometimes referred to as a first internal guide.

Figure 8:
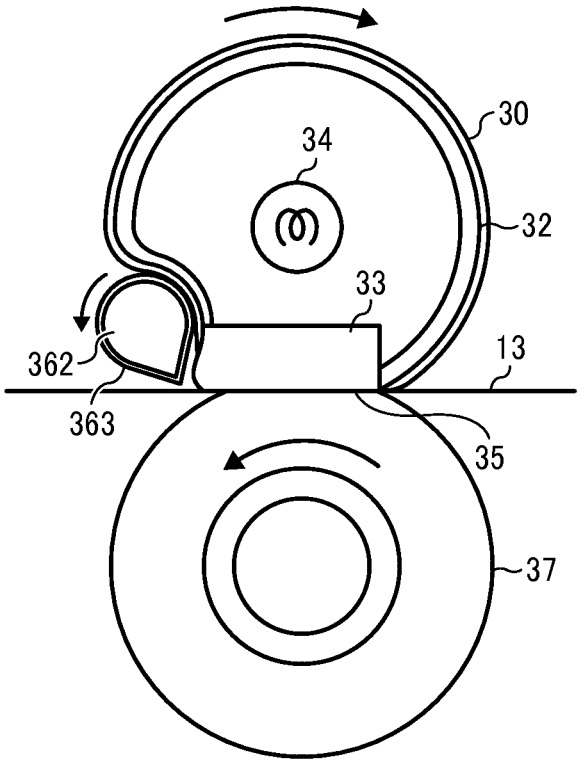
FIG. 8 is a schematic view illustrating yet another example of the fixing device of the present embodiment.

FIG. 8 is a schematic view illustrating yet another example of the fixing device of the present invention. The difference between the fixing device illustrated in FIG. 8 and the fixing device illustrated in FIG. 7 is that the external guide 361 of the fixing device illustrated in FIG. 7 is replaced with a guide constituted of a second internal guide 362 and a second endless belt 363. Namely, the combination of the second endless belt 363 and the second internal guide 362, which is located inside the second endless belt 363, serves as an external guide and executes the function of the external guide 361.

The second internal guide 362 has a main body, which is made of a metal such as iron and aluminum and whose surface is coated with a fluorine-containing resin to reduce friction between the second internal guide 362 and the second endless belt 363. Alternatively, the surface of the second internal guide 362 may be coated with a lubricant such as grease instead of such a fluorine-containing resin. The second internal guide 362 has a shape similar to that of the external guide 361. Specifically, the portion of the second internal guide 362 facing the endless belt 30 has a gently curved surface to reduce friction while having a sharp edge, which faces the exit of the fixing nip 35. Specific examples of the shape include such a teardrop shape as illustrated in FIG. 8.

The second endless belt 363 typically has a structure such that on a substrate made of a material such as a nickel or polyimide film and having a thickness of tens of micrometers, a fluorine-containing resin layer having a thickness of tens of micrometers is formed on the surface of the substrate as an outermost layer. The second endless belt 363 is preferably as thin as possible so as to have the same shape as that of the internal guide 362, and the thickness thereof is preferably from 20 μm to 50 μm.

Similarly to the fixing device illustrated in FIG. 7, when the recording medium 13 exits from the fixing nip 35 and is nearly wound around the endless belt 30 in the fixing device illustrated in FIG. 8, the sharp edge of the second endless belt 363 forcibly releases the recording medium 13 from the endless belt 30 because the sharp edge is located between the recording medium 13 and the endless belt 30, and therefore the recording medium can be easily released stably from the endless belt even when the recording medium is so thin that the recording medium cannot perform curvature releasing. In addition, since the second endless belt 363 is driven by the endless belt 30 to rotate, friction between the endless belt 30 and the second endless belt 363 is low so that the endless belt 30 can stably rotate. In addition, the surface of the endless belt 30 is hardly damaged, and therefore deterioration of image quality of fixed images caused by scratch on the surface of the endless belt 30 can be prevented.

As mentioned above, the fixing device and the image forming apparatus of the present invention can stably perform a printing operation by securely releasing a recording medium from the fixing device even when the recording medium used is thin and has low rigidity, and a solid image is formed on the entire surface of the recording medium. In addition, the endless belt can be driven by a device having a simple structure. Further, since the endless belt is directly heated by a heater, the fixing device has low heat capacity, and therefore a printing operation can be started with a short start-up time.

As mentioned above, according to the present invention, a fixing device and an image forming apparatus, which can securely feed a recording medium without causing the winding problem even when the recording medium has low rigidity and bears a solid image on the entire surface thereof.

Additional modifications and variations of the present invention are possible in light of the above teachings. It is therefore to be understood that within the scope of the appended claims the invention may be practiced other than as specifically described herein.

What is claimed is:

1. A fixing device comprising:
a first endless belt;
a pressing pad inside the first endless belt;
a pressing roller configured to,
be in contact with the pressing pad with the first endless belt therebetween to form a fixing nip, and
drive the first endless belt to rotate;
a first internal guide configured to position the first endless belt; and
an external guide configured to contact an outer surface of the first endless belt at an exit side of the fixing nip to deform the first endless belt.

2. The fixing device according to claim 1, wherein the external guide is configured to be rotatable.

3. The fixing device according to claim 1, wherein the external guide includes:
a second endless belt; and
a second internal guide inside the second endless belt and configured to support the second endless belt.

4. The fixing device according to claim 1 further comprising:
a heater, wherein
the first internal guide is configured to guide both end portions of the first endless belt so that the first endless belt rotates while being positioned, and
the heater is configured to directly heat the first endless belt.

5. The fixing device according to claim 4, wherein the heater is inside the first endless belt.

6. The fixing device according to claim 4, wherein
the pressing roller includes a hollow cylinder as a core, and
the heater is inside the hollow cylinder.

7. The fixing device according to claim 4, wherein
the pressing roller has an electroconductive layer as an outermost layer, and
the heater heats the electroconductive layer with induction current.

8. An image forming apparatus comprising:
a photoreceptor;
an electrostatic latent image forming device configured to form an electrostatic latent image on a surface of the photoreceptor;
a developing device configured to develop the electrostatic latent image with a developer including a toner to form a toner image on the surface of the photoreceptor;
a transferring device configured to transfer the toner image onto a recording medium; and
the fixing device according to claim 1 configured to fix the toner image on the recording medium.

9. The fixing device according to claim 1, wherein the first endless belt has a dimple at a location at which the external guide contacts the outer surface of the first endless belt.

10. The fixing device according to claim 1, wherein the external guide forms a recessed portion in the deformed first endless belt such that deformation of the first endless belt in a feeding direction of a recording medium passing through the fixing device is prevented.

11. The fixing device according to claim 1, wherein an outer perimeter of a combination of the pressing pad and the first internal guide is shorter than an inner perimeter of the first endless belt.

12. The fixing device according to claim 1, wherein a ratio of an inner perimeter of the first endless belt to an outer perimeter of a combination of the pressing pad and the first internal guide is in a range of 100:98 to 100:95.

13. A fixing device comprising:
a first endless belt;
a pressing pad inside the first endless belt;
a pressing roller configured to,
be in contact with the first endless belt therebetween to form a fixing nip, and
drive the first endless belt to rotate;
a first internal guide configured to position the first endless belt; and
an external guide configured to contact an outer surface of the first endless belt at an exit side of the fixing nip to deform the first endless belt, the external guide including a second endless belt and a second internal guide located inside the second endless belt to support the second endless belt.

* * * * *